United States Patent [19]

Herold et al.

[11] 3,945,095

[45] Mar. 23, 1976

[54] METHOD AND APPARATUS FOR ALIGNING A STACK OF SHEETS

[75] Inventors: Hans Herold, Bonn; Manfred Klahre, St. Augustin, both of Germany

[73] Assignee: Hans Herold Maschinenfabrik, Bonn, Germany

[22] Filed: May 30, 1974

[21] Appl. No.: 474,684

[30] Foreign Application Priority Data

June 14, 1973 Germany ..... 2330245

[52] U.S. Cl. ..... 271/210; 34/38; 34/150

[51] Int. Cl.[2] ..... B65H 31/40

[58] Field of Search ..... 271/210, 221, 222, 146; 214/65; 34/150, 164, 23, 38

[56] References Cited

UNITED STATES PATENTS

| | | | |
|---|---|---|---|
| 3,656,743 | 4/1972 | Ruud | 271/210 X |
| 3,724,089 | 4/1973 | Thompson et al. | 34/150 X |
| 3,815,259 | 6/1974 | Atwood et al. | 34/150 |
| 3,842,995 | 10/1974 | Dooley | 271/210 X |

*Primary Examiner*—Evon C. Blunk
*Assistant Examiner*—Bruce H. Stoner, Jr.
*Attorney, Agent, or Firm*—Michael J. Striker

[57] ABSTRACT

An apparatus for aligning the edges of a stack of sheets comprises a base and two plates mounted on the base for movement independently of one another. An oscillatory drive arrangement imparts oscillatory motion to the plates, the amplitude, frequency and orientation of the oscillatory movement being independently adjustable for each of the plates. A stack of sheets the edges of which are to be aligned is arranged on the plates so as to be supported on the plates on their support edges, and the oscillatory motion causes the individual sheets to move in a predetermined direction until the leading edges of the individual sheets reach an abutment preventing further movement of the sheets. A substantial volume of low-pressure air is blown between the individual sheets so as to separate them from one another and facilitate their independent movement toward the abutment. A pair of upright walls extends parallel to the direction of movement of the sheets so as to laterally support the stack. A method of aligning the sheet edges is also disclosed.

7 Claims, 4 Drawing Figures

METHOD AND APPARATUS FOR ALIGNING A STACK OF SHEETS

BACKGROUND OF THE INVENTION

The present invention relates to a method and an apparatus for aligning the edges of adjacent sheets arranged in a stack, such as paper sheets, paperboards, cardboards and the like.

In many fields of human endeavor, such as in the paper manufacturing, printing and packaging industries, there is a need for accurately aligning the edges of sheets arranged in a stack, for instance, for subsequent printing, trimming or binding operations. In many instances, particularly when the sheets are already provided with fresh printed indicia thereon, it is also necessary to assure that the individual sheets of the stack are separated from one another by an air cushion at least during the alignment operation so as to prevent smudging of the fresh print or transfer thereof from one sheet to another as the individual sheets conduct movement relative to one another.

To achieve these objectives, it is already known to provide an apparatus having a base and a plate on which the individual sheets are being stacked or to which the stack is supplied, and to subject the stack to oscillatory motion by vibrating the plate. However, experience has shown that such an apparatus obtains unsatisfactory results due to the fact that all of the individual sheets are subjected to the same oscillatory motion so that the sheets show indifferent behavior with respect to one another, that is they move in unison, at least up to the time that some of the leading edges of the sheets in the direction of movement of the stack abut against an abutment element. In addition thereto, there is a tendency of the individual sheets to adhere to one another, either due to the friction between the sheets or to the electrostatic charge thereon, or for any other reasons. As a result of this the movement of some of the sheets may terminate before the leading edge thereof reaches the abutment element.

There are also already known apparatuses in which the problem of the individual sheets adhering to one another during or subsequently to the stacking operation has been avoided or at least substantially so by introducing air between the individual sheets so as to in effect form air cushions between the same. However, because of the inherently low stability of the paper sheets, paperboards or cardboards, the alignment of the edges of the sheets while air is introduced between the individual sheets has encountered considerable difficulties. As a result of this, the heretofore known devices for aligning the edges of the adjacent sheets have found only a limited application, particularly because of the cumbersome and unreliable operation thereof.

SUMMARY OF THE INVENTION

It is a general object of the present invention to avoid the disadvantages of the prior-art devices for aligning the edges of stacked sheets.

It is a further object of the invention to provide a new and improved method of aligning the edges of sheets, such as paper sheets, cartons and cardboards arranged in a stack, which method is simpler and more reliable than the previously known methods.

Still another object of the invention is to provide a device for aligning the edges of sheets of relatively large dimensions, such as paper sheets, cartons or cardboards in a reliable manner so that no further manual operations are needed for achieving a throughout correct edge alignment thereof.

In keeping with these objects, and others which will become apparent hereafter, one feature of the invention resides in a device for aligning the edges of paper sheets, cartons and cardboards, in a bottom plate upon which paper sheets, cartons and cardboards are stacked in vertical positions, the bottom plates being subdivided in at least two independently mounted oscillatory plates, each of which is operated by an independent drive arrangement.

Paper sheets, cartons and/or cardboards may be supplied onto the mutually independently mounted oscillatory plates, each of which is actuated by its own independent drive arrangement. In order to achieve proper operation, the individual drive arrangements operate in such a manner as to avoid mutually insensitive and indifferent behavior affecting the stack of the material to be aligned during the aligning motion or vibration.

Thereby, for obtaining the best possible alignment of the material stack, each one of the driving arrangements is adjustable in regard to the direction, frequency and amplitude of the swinging motion effected.

In the device according to the invention, it is further provided for preventing the material in the stack to suffer any possible damage or mutilation that could be caused by the oscillating plates performing mutually interdependent shaking movements. According to one of the features of the invention, the adjacent oscillatory plates are equipped on their surfaces facing the stack of sheets to be aligned with support bars extending parallel to one another, the bars of one of the plates alternating with the bars of the other plate. The support bars located on one of the oscillatory plates protrude across and beyond the slot separating the oscillatory plates and partly enter the intermediate spaces between the support bars arranged on the other of said oscillatory plates. It is particularly important that the support bars on only one of said oscillatory plates transgress said slot between the oscillatory plates. Otherwise, the aligning effect in this transitional zone could be hampered, the vibrations of the material stack could be infavorably affected and, under certain conditions, a failure in the stacking operation could occur.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
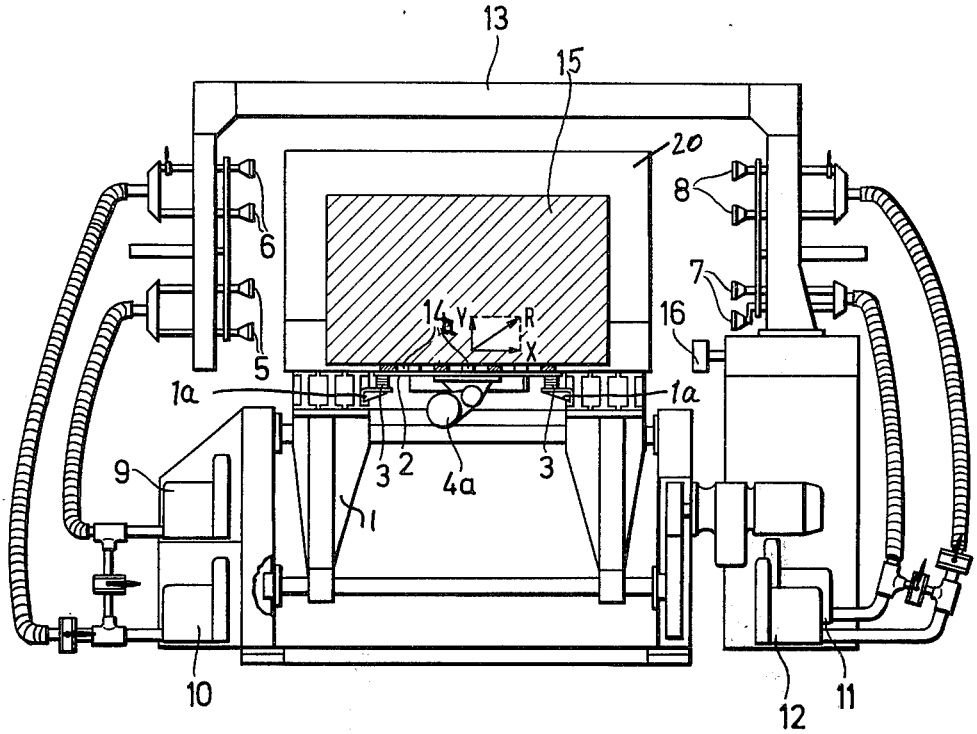
FIG. 1 is a partially cross-sectioned side elevational view of a device according to the invention.

Discussing the drawing in detail, and firstly FIG. 1 thereof, it will be seen that the edge-aligning device according to the invention includes a base 1 which is provided with carrier projections 1*a*. A plate 2 is mounted on the base 1 for movement relative thereto, and a plurality of elastic elements 3 extends between the respective carrier projections 1*a* and the plate 2, being attached thereto and supporting the same on the base 1.

Figure 3:
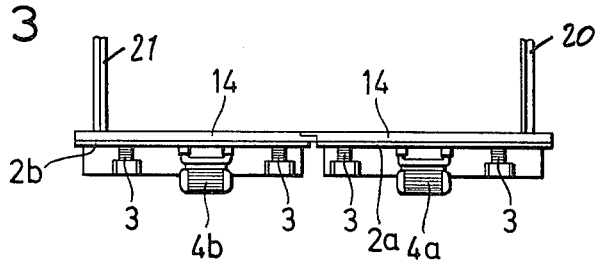
FIG. 3 is a cross-sectional view of the swinging plates taken on line III—III of FIG. 2.
Figure 2:
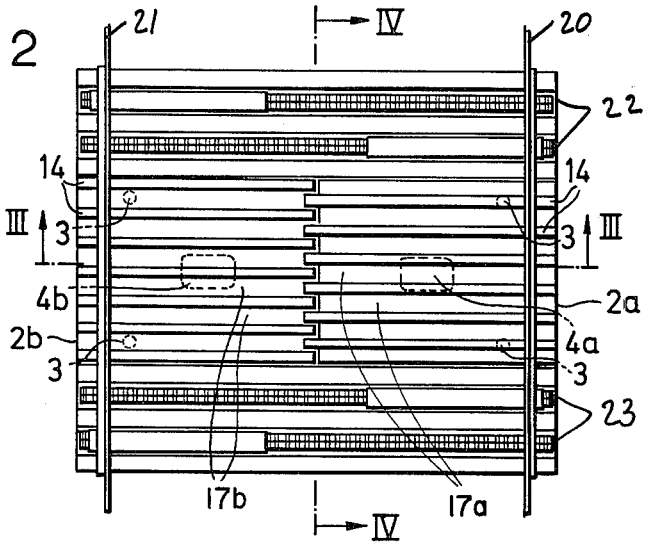
FIG. 2 is a top plan view of the oscillatory plates used in such a device.
Figure 4:
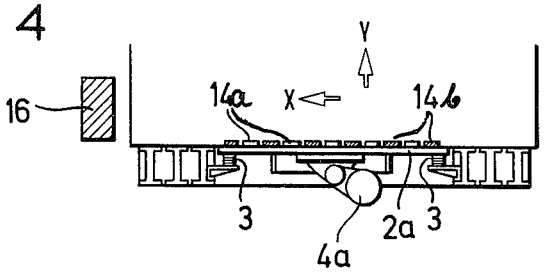
FIG. 4 is a cross-sectional view of the swinging plates taken on line IV—IV of FIG. 2.

It may be seen from FIGS. 2 to 4 that the plate 2 is subdivided into two plates 2*a* and 2*b*, each of which is mounted on the base 1 independently of the other. With each plate 2*a* and 2*b*, there is operatively associated an oscillatory drive unit 4*a* and 4*b*, respectively, which is adapted to impart to the respective plate 2*a* or 2*b* an oscillatory motion, the amplitude, frequency and direction of which can be adjusted independently of the oscillatory motion being simultaneously imparted to the other plate 2*b* or 2*a*. While the currently preferred embodiment of the invention utilizes two independent drive units 4*a* and 4*b*, it is to be understood that there may be provided a common power unit independently imparting oscillatory motions to the two plates 2*a* and 2*b*. The drive units themselves are of conventional design and, therefore, not discussed in detail. It is only pointed out that they may be of the electromotor type, or the electromagnetic type or of the hydraulic or pneumatic type depending on the design considerations. A very important consideration in selecting the proper drive units is, however, that the units be of the type in which it is possible to gradually control the amplitude, frequency and direction of the oscillatory motion by electronic, mechanical or hydraulic means.

The drive units 4*a* and 4*b*, in the currently preferred embodiment of the invention, are located underneath the respective plates 2*a* and 2*b*, and spaced from the elastic elements 3 so that the respective plates 2*a* and 2*b* are connected to the base 1 via the elastic elements 3 and the respective drive units 4*a* and 4*b*, each of which permits relative displacement of the respective plate 2*a* or 2*b* with respect to the base 1.

A plurality of carrier rods 14*a*, 14*b* is attached to the upper surface of each of the plates 2*a* and 2*b*which are located adjacent one another being separated from one another by a gap. The rods of the two plates 2*a* and 2*b* extend parallel to one another, separated by interspaces 17*a*, 17*b*, the rods 14*a* of the plate 2*a* being staggered with respect to the rods 14*b* of the plate 2*b*. The rods 14*a* of the plate 2*a* project across and beyond the gap between the two plates 2*a* and 2*b* and into the spaces between the rods 14*b* of the plate 2*b*. The projecting portions of the rods 14*a* are always out of contact with the rods 14*b*, regardless of the respective oscillatory motions being imparted to the plates 2*a* and 2*b*.

The plates 2*a* and 2*b*, and particularly the rods 14*a* and 14*b* are adapted to support a stack 15 of adjacent sheets to be edge-aligned on support edges of the sheets, and to impart oscillatory motion thereto. Since the two plates 2*a* and 2*b* are being driven into oscillation by two independently adjustable drive units 4*a* and 4*b*, two different oscillatory motions are in fact imparted to two different regions of the stack 15 so that the substantially vertically oriented sheets in these two regions will perform different motions. As a matter of fact, when the friction between the individual sheets comes into the picture, the result will be that each of the sheets will conduct a movement at least slightly different from the movement of the adjacent sheets. As a result of this, the sheets will not move in unison but rather individually.

In order to avoid the possibility that the adhesion of the sheets to one another would impair their independent movements, which adhesion may be the result of an electrostatic charge on the individual sheets, the excessive friction between the individual sheets or other factors, and in order to prevent smudging of not yet completely dry printed indicia on the individual sheets if such are provided, air is admitted between the individual sheets in order to separate the same from one another either prior to and/or during the edge-alignment thereof. To achieve this, the currently preferred embodiment of the device according to the invention comprises four pairs of nozzles 5, 6, 7, 8 which are directed into the space above the plates 2*a* and 2*b*. A substantial quantity of air at low pressure is supplied to the nozzles 5, 6, 7 and 8, being propelled by blowers 9, 10, 11 and 12, respectively. The nozzles 5, 6 and 7, 8 are preferably arranged in vertical rows adjacent the lateral sides of the plates 2*a* and 2*b*, and are mounted on a substantially U-shaped frame 13 which is mounted for displacement forwardly and rearwardly with respect to the plates 2*a* and 2*b*. In this manner, air will be blown between the individual sheets of the stack 15 in various regions thereof. It is to be understood that any other number or arrangement of the nozzles or of the blowers is also possible depending on the particular requirements.

In order to increase the versatility of the device according to the invention and the possibility to use the same for edge-alignment of sheets of different major surface areas, a pair of upright front and rear walls 20 and 21 is mounted on the plates 2*a* and 2for displacement with respect thereto. The walls 20 and 21 restrain the movement of the stack 15 to only one direction, that is from one of the lateral sides of the plates 2*a*, 2*b* to the other lateral side. An abutment element 16 is arranged adjacent the other lateral side and provides for limiting the extent of movement of the individual sheets in the above-mentioned direction.

The operation of the device according to the invention will now be described.

The stack 15 of the sheets to be edge-aligned is rotated by 90° from a position in which the sheets are superimposed, and positioned on the bars 14*a* and 14*b* of the plates 2*a* and 2*b* between the upright walls 20 and 21, while the drive units 4*a* and 4*b* are still inoperative. The oscillatory characteristic of the drive units 4*a* and 4*b* is adjusted to the type of material to be edge-aligned, for instance by adjusting the angular position of the drive units 4*a* and 4*b* so as to properly select the desirable values of the components of the oscillatory motion in the X and Y directions indicated by arrow in FIGS. 1 and 4. The X and Y components of the oscillatory motions of the plates 2*a* and 2*b* are preferably selected differently from one another so that, once the drive units 4*a* and 4*b* are activated, different oscillatory motions will be imparted to different regions of the stack 15.

Prior to the activation of the drive units 4*a* and 4*b*, however, the abutment element 16 is displaced from its rest position indicated in FIG. 1 to an extended position closely adjacent the right-hand side of the stack 15 as seen in FIG. 1, and the blowers 9, 10, 11 and 12 are energized so as to deliver air to the nozzle pairs 5, 6, 7 and 8. The air emitted from the nozzles 5, 6, 7 and 8 penetrates between the individual sheets of the stack 15, thus effectively separating them from one another. Since the frame 13 is displaceable forwardly and rearwardly, eventually all of the individual sheets will be separated from one another. After this preaeration operation is performed, the drive units 4*a* and 4*b* are activated and impart to the plates 2*a* and 2*b* oscillatory motions at high frequency and low amplitude. The relatively small Y component of the oscillatory motion results in alignment of the stack 15 on the support edges thereof which rest on the bars 14*a* and 14*b*. On the other hand, the relatively large X component of the oscillatory motion causes the individual sheets, groups of the same and/or the entire stack 15 to travel in the direction toward the abutment element 16, and when the leading edges of the individual sheets come into contact with the abutment element 16, the movement of the individual sheets in this direction is terminated. The movement of the individual sheets is greatly enhanced by the fact that the air is admitted between the individual sheets through the nozzles 5, 6, 7 and 8. In addition thereto, the admission of the air between the sheets assures their effective separation from one another by air cushions so that, as the individual adjacent sheets are displaced relative to one another, the smudging of the possibly freshly printed indicia is prevented.

It will be understood that each of the elements described above, or two or more together, may also find a useful application in other types of constructions differing from the type described above.

While the invention has been illustrated and described as embodied in a device for aligning the edges of sheets, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for aligning the edges of a plurality of adjacent sheets arranged in a stack comprising, in combination, a base; at least two plates mounted on said base laterally adjacent one another for independent movement with respect to said base and to each other, and defining with one another an elongated gap, each of said plates having an upper side provided with a plurality of spaced parallel bars operative for supporting the stack of laterally adjacent sheets thereon and extending transverse to the elongation of said gap, said parallel bars having end portions which extend across said gap and interdigitate with but do not contact the end portions of the bars on the respective other plate; motion-imparting means for independently imparting oscillatory motion to each of said plates to cause attendant displacement of the individual sheets of the stack in a predetermined direction; and abutment means extending transversely of said direction for abutment with the leading edges of the sheets which are being displaced, whereby the extent of such displacement in said direction is limited so that the leading edges of the sheets become aligned with one another.

2. A method of aligning the edges of a plurality of adjacent sheets arranged in a stack, comprising the steps of supporting the stack on the support edges of the laterally adjacent sheets; subjecting the support edges of only some of the adjacent sheets to an oscillatory force and the support edges of others of the adjacent sheets to a different oscillatory force with attendant differential displacement of the individual adjacent sheets of the stack in a predetermined direction; and aligningly engaging the leading edges of the individual adjacent sheets so as to terminate said displacement thereof so that the leading edges become aligned with one another.

3. A method as defined in claim 2; and further comprising the step of blowing gaseous fluid between the respective sheets of said stack.

4. A device for aligning the edges of a plurality of adjacent sheets arranged in a stack, comprising first and second means for supporting the stack on the support edges of the laterally adjacent sheets; means for subjecting said first supporting means and thereby the support edges of only some of the laterally adjacent sheets to a first positive oscillatory force and for subjecting said second supporting means and thereby the support edges of others of the adjacent sheets to a different second positive oscillatory force with attendant differential displacement of the individual adjacent sheets of the stack in a predetermined direction; and means for aligningly engaging the leading edges of the individual adjacent sheets so as to terminate said displacement thereof so that the leading edges become aligned with one another.

5. A device as defined in claim 4; and further comprising means for blowing gaseous fluid against the edges of said sheets for penetration between the sheets of said stack.

6. A device as defined in claim 4, wherein each of said supporting means includes at least one independent plate and wherein said subjecting means includes at least two independent drives, one for each of said plates.

7. A device as defined in claim 4, wherein each of said supporting means includes at least one independent plate; and wherein said subjecting means includes at least two drives, each acting upon one of said plates and each being adjustable independently of the other with respect to the direction, frequency and amplitude of the oscillatory motion which it imparts to the associated plate.

* * * * *